US010648769B2

(12) United States Patent
Thomele et al.

(10) Patent No.: US 10,648,769 B2
(45) Date of Patent: May 12, 2020

(54) HANDGUN GRIP MODULE WITH A REINFORCING BRACKET

(71) Applicant: Sig Sauer, Inc., Newington, NH (US)

(72) Inventors: Adrian Thomele, Stratham, NH (US); Jason Knight, Exeter, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 16/229,681

(22) Filed: Dec. 21, 2018

(65) Prior Publication Data

US 2019/0195596 A1 Jun. 27, 2019

Related U.S. Application Data

(60) Provisional application No. 62/609,973, filed on Dec. 22, 2017.

(51) Int. Cl.

| | |
|---|---|
| ***F41C 27/00*** | (2006.01) |
| ***F41C 27/22*** | (2006.01) |
| ***F41C 23/10*** | (2006.01) |
| ***F41C 23/18*** | (2006.01) |
| ***F41A 3/66*** | (2006.01) |
| ***F41A 35/00*** | (2006.01) |

(52) U.S. Cl.

CPC ..... *F41C 27/22* (2013.01); *F41A 3/66* (2013.01); *F41A 35/00* (2013.01); *F41C 23/10* (2013.01); *F41C 23/18* (2013.01)

(58) Field of Classification Search

CPC ..... F41C 27/22; F41C 23/10; F41A 15/10
USPC ..... 89/197, 196; 42/7, 71.02
See application file for complete search history.

(56) References Cited

U.S. PATENT DOCUMENTS

| | | | | |
|---|---|---|---|---|
| 4,593,601 | A | 6/1986 | Smith | |
| 6,234,059 | B1 * | 5/2001 | Fuchs | F41A 3/66 89/195 |
| 6,401,379 | B1 | 6/2002 | Moon | |
| 6,993,864 | B1 * | 2/2006 | O'Clair | F41A 3/14 42/71.02 |
| D598,065 | S | 8/2009 | Vukovic et al. | |
| D654,978 | S | 2/2012 | Karanian et al. | |

(Continued)

OTHER PUBLICATIONS

"Instruction Manual for Ruger American Pistol Pro Model", Sturm, Ruger & Co., Inc. (2016). 43 pages.

(Continued)

*Primary Examiner* — Reginald S Tillman, Jr.
(74) *Attorney, Agent, or Firm* — Finch & Maloney PLLC

(57) ABSTRACT

A handgun grip module includes a body portion extending longitudinally with a first body sidewall, a second body sidewall spaced from the first body sidewall, and a bottom body portion extending between and connecting the first body sidewall and the second body sidewall. The body portion has a distal body portion defining a recoil spring channel and a proximal body portion defining a frame box. A recoil block in the body portion is positioned between the recoil spring channel and the frame box and extends laterally between the first body sidewall and the second body sidewall. The recoil block has a distal face and a proximal face. A metallic bracket is disposed against the distal face of the recoil block. A handgrip portion extends transversely down from the body portion and defines a magazine well extending therethrough to the frame box.

17 Claims, 8 Drawing Sheets

(56) References Cited

U.S. PATENT DOCUMENTS

| | | | | |
|---|---|---|---|---|
| D681,131 | S | 4/2013 | Su | |
| 8,448,364 | B2 | 5/2013 | Davidson | |
| D690,374 | S | 9/2013 | Lee | |
| D692,513 | S | 10/2013 | Yigit | |
| 9,021,730 | B2 | 5/2015 | Gentilini et al. | |
| D744,049 | S | 11/2015 | Chu | |
| 9,194,654 | B1 | 11/2015 | Viani | |
| D754,802 | S | 4/2016 | Martelli et al. | |
| 9,303,936 | B2 | 4/2016 | Toner | |
| 9,310,160 | B1 * | 4/2016 | DiChario | F41C 23/10 |
| D755,324 | S | 5/2016 | Martelli et al. | |
| D755,907 | S | 5/2016 | Hu | |
| D758,519 | S | 6/2016 | Toner et al. | |
| 9,441,897 | B2 | 9/2016 | Mather et al. | |
| 9,546,831 | B2 | 1/2017 | Bandini et al. | |
| 9,551,550 | B2 | 1/2017 | Wells | |
| 9,664,471 | B1 | 5/2017 | Curry et al. | |
| D791,262 | S | 7/2017 | Brown et al. | |
| D803,341 | S | 11/2017 | Wolfe | |
| D808,487 | S | 1/2018 | Beville et al. | |
| D814,593 | S | 4/2018 | O'Clair et al. | |
| D814,596 | S | 4/2018 | Curry | |
| D815,233 | S | 4/2018 | Toner et al. | |
| D823,969 | S | 7/2018 | Beville et al. | |
| D828,881 | S | 9/2018 | Lee | |
| D828,892 | S | 9/2018 | Kellgren | |
| D830,480 | S | 10/2018 | Chu | |
| 10,088,269 | B2 | 10/2018 | Sheets, Jr. et al. | |
| D834,656 | S | 11/2018 | Chu | |
| 2001/0037596 | A1 | 11/2001 | Salvitti | |
| 2019/0154368 | A1 * | 5/2019 | Kim | F41A 11/02 |

OTHER PUBLICATIONS

"Instruction Manual for Ruger American Pistol, Standard Model", Sturm, Ruger & Co., Inc. (2016). 44 pages.

Ruger American Pistol Pro Model Parts List, pp. 34-37 (2016).

* cited by examiner

HANDGUN GRIP MODULE WITH A REINFORCING BRACKET

RELATED APPLICATIONS

This application claims priority under 35 U.S.C. § 119(e) to U.S. Provisional Patent Application No. 62/609,973 titled HANDGUN FRAME WITH A REINFORCING BRACKET and filed on Dec. 22, 2017, the contents of which are incorporated herein by reference in its entirety.

FIELD OF THE DISCLOSURE

This disclosure relates to firearm assemblies and more particularly to a handgun grip module with a reinforcing bracket.

BACKGROUND

Traditionally, handguns have included a metal frame to which additional components are attached, such as the fire control group, barrel, slide, safety levers, grips, and other parts of the handgun. The advent of handguns with a polymer grip module has been accompanied by new challenges in firearms design. Instead of a steel frame, some handguns have a polymer grip module that includes a hand grip, trigger guard, and slide portion that extends distally along the barrel and slide. A separate metal frame is installed into a box defined along the top of the grip module. The frame is the serialized component that includes the fire control group. Some such handguns are striker-fired, where the action includes a striker held in spring tension until released by pulling the trigger to release the striker forward to impact the ammunition primer.

SUMMARY

One aspect of the present disclosure is directed to embodiments of a handgun having novel features for retaining the frame in the grip module. One aspect of the present disclosure relates to a polymer grip module with a metallic bracket or insert positioned adjacent the recoil block. Another aspect of the present disclosure relates to a handgun grip module with a frame installed in a frame box defined in the body portion of the grip module, where the frame contacts the grip module at a metallic bracket and at one or more lugs in the grip module.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
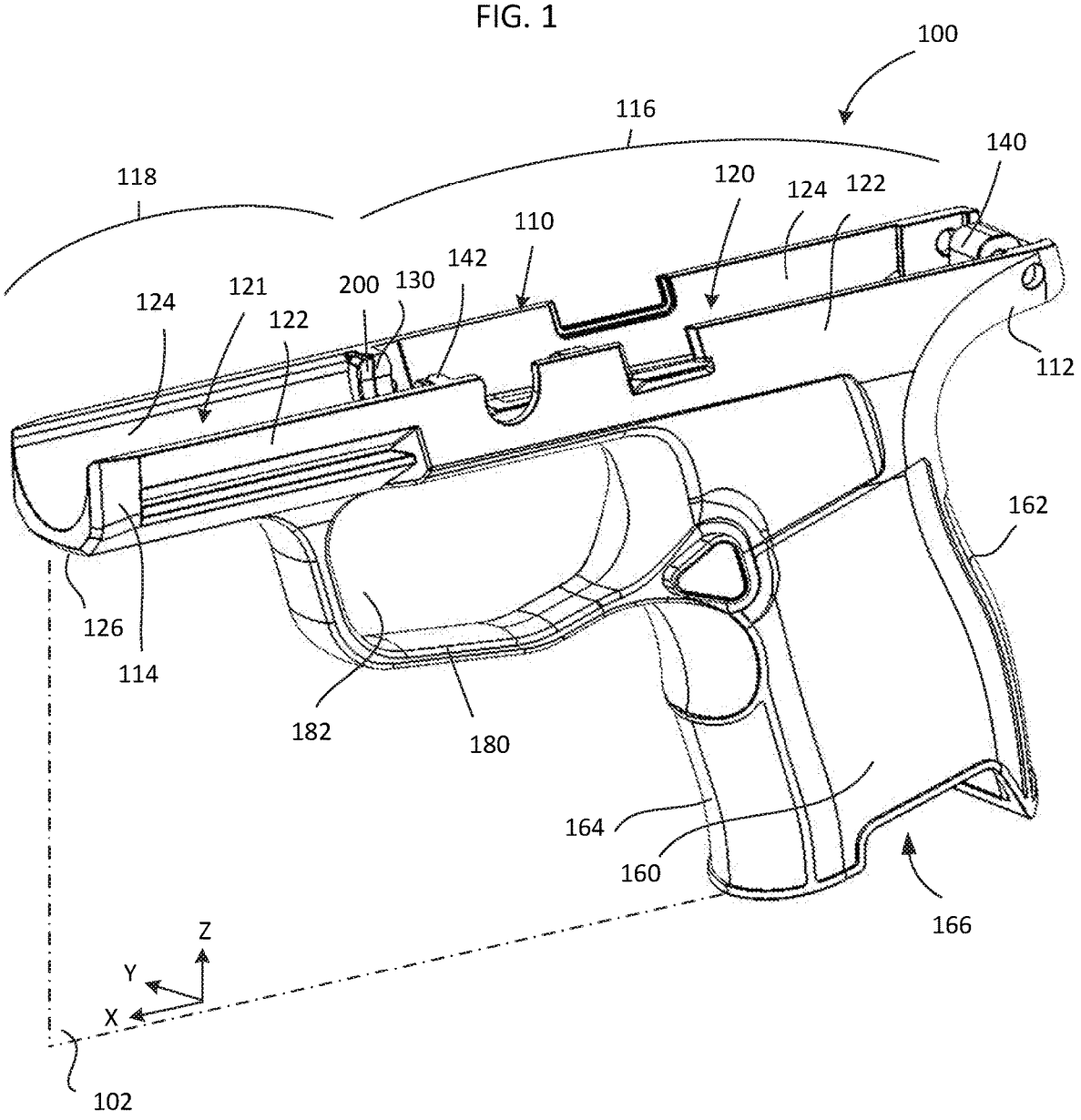
FIG. 1 illustrates a top, front, and left-side perspective view of a handgun grip module, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

Aspects of a handgun assembly are disclosed. In accordance with some embodiments of the present disclosure, a polymer handgun grip module has a metallic bracket disposed in the grip module. For example, the metallic bracket is positioned in contact with a distal face of a recoil block that extends between opposed sidewalls of the grip module between the recoil spring channel and the frame box. The metallic bracket can include one or more protrusions that extend through the recoil block to engage the distal end of the frame to retain the frame in the frame box. The metallic bracket can be molded into the grip module in some embodiments.

Some embodiments of a handgun grip module and handgun assembly of the present disclosure advantageously distribute recoil energy, reinforce the polymer handgun grip module, and allow for a reduced size of the handgun. For example, a reduced overall height of the recoil spring channel moves the bore axis closer to the user's hand for improved control and shooting accuracy. Numerous configurations and variations will be apparent in light of this disclosure.

As discussed herein, terms referencing direction, such as upward, downward, vertical, horizontal, left, right, front, back, etc., are used for convenience to describe embodiments as conventionally oriented and as shown in the figures. Embodiments according to the present disclosure are not limited by these directional references and it is contemplated that a handgun grip module and other components discussed herein could be used in any orientation.

General Overview

As noted above, non-trivial issues arise that complicate weapons design and performance of semiautomatic handguns. Due in part to their lighter weight, handguns having a polymer grip module are preferred by some gun owners who carry their handguns on a regular basis, especially those who carry concealed. Also, some such handguns incorporate a modular design that allows the user to change grips, barrel length, and caliber as desired by the user. For example, the frame is a separate serialized component that can be moved from one grip module to another, where each grip module may have a different grip configuration. Similarly, the slide assembly and barrel can be changed to accommodate a barrel with a different length and/or a different caliber.

Traditionally, the recoil energy of a semiautomatic handgun is absorbed primarily through the takedown lever and transmitted to the grip. The recoil force occurs upon firing when the slide moves rearward followed by the spring guide at the distal end of the slide contacting the slide block adjacent the takedown lever. The barrel also absorbs force as it moves back and stops abruptly. To repeatedly withstand the recoil energy and other forces, the polymer grip module may require an increased wall thickness in order to have the durability and reliability comparable to that of handguns made of metal. In some polymer grip modules, for example, the walls of polymer material have been made thicker than that of their metal counterparts. Accordingly, handguns with a polymer grip module are structurally sound for firing ammunition, but may be perceived as being bulky and inelegant.

Consumers continue to demand handguns that not only are reliable and accurate, but also light weight and compact. To meet these demands, a need exists for further improvements in polymer grip module of handguns, such as a grip module with reduced bulk and a narrower cross section. Accordingly, the present disclosure relates to improvements to a polymer grip module, a handgun subassembly, and a handgun. In one embodiment of the present disclosure, a polymer grip module for a handgun includes a metallic bracket disposed against the recoil block. The metallic bracket can be partially or completely molded into the grip module, such as overmolded into the grip module. In one embodiment, the metallic bracket is overmolded into the recoil block and has one or more protrusions that extend through the recoil block to engage the distal end of the frame to retain the frame in the grip module. In other embodiments, the grip module includes one or more lugs extending laterally through the frame. The frame engages the lugs when it is installed in the grip module. In addition to other points of contact, the lugs are areas where the frame contacts the grip module, thereby further distributing recoil forces. These features individually and together distribute recoil forces more evenly to the grip module, where such forces otherwise would be concentrated near the takedown lever and slide block. By doing so, recoil energy and other forces are not concentrated in local areas in the grip module and the grip module can be made more compactly and/or with reduced thicknesses than in other designs. Advantageously, the handgun grip module can be produced with a more compact design.

As will be appreciated in light of this disclosure, and in accordance with some embodiments, features of a polymer grip module with metallic bracket can be used with striker-fired and hammer-fired handguns alike. In addition, the principles of these features can be applied to rifles and shotguns to secure the frame into a wood or polymer stock to distribute forces through the stock. In accordance with some example embodiments, a polymer grip module with a metallic bracket is provided as part of a semiautomatic handgun chambered in 0.380 Auto, 9 mm Luger, 0.357 SIG, 10 mm Auto, 0.40 S&W, 0.45 ACP, or other suitable pistol ammunition. Other suitable host firearms and chamberings will be apparent in light of this disclosure.

In accordance with some embodiments, the disclosed apparatus may be detected, for example, by visual inspection of a handgun or handgun subassembly having features such as a metallic bracket disposed in contact with the recoil block of a polymer grip module and a metallic bracket with at least one protrusion engaging a distal frame end portion.

While generally referred to herein as a metallic bracket for consistency and ease of understanding the present disclosure, the disclosed metallic bracket is not limited to that specific terminology and alternatively can be referred to, for example, a reinforcing bracket, a metal insert, a frame insert, a recoil block reinforcement, a retaining bracket, or other terms. As will be further appreciated, the particular configuration (e.g., materials, dimensions, etc.) of a metallic bracket configured as described herein may be varied, for example, depending on whether the intended use is military, tactical, or civilian in nature. Numerous configurations will be apparent in light of this disclosure.

Structure and Operation

Figure 2:
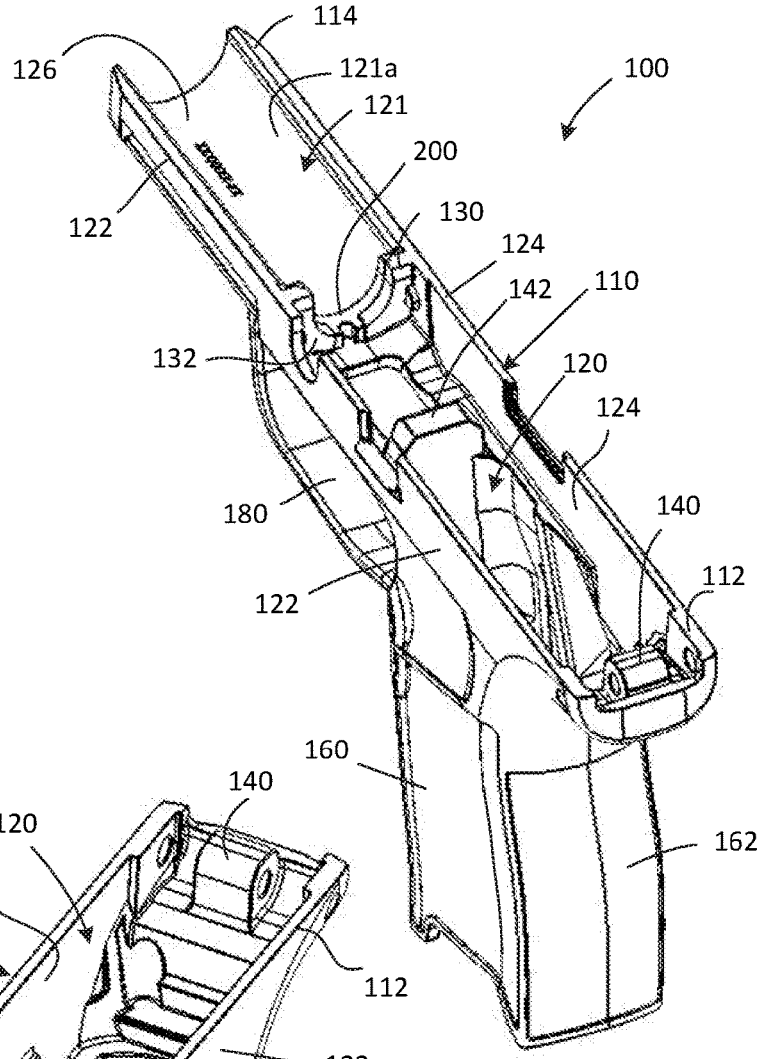
FIG. 2 illustrates a top, rear, and left-side perspective view of the grip module of FIG. 1 showing the frame box and the recoil spring channel, in accordance with an embodiment of the present disclosure.
Figure 3:
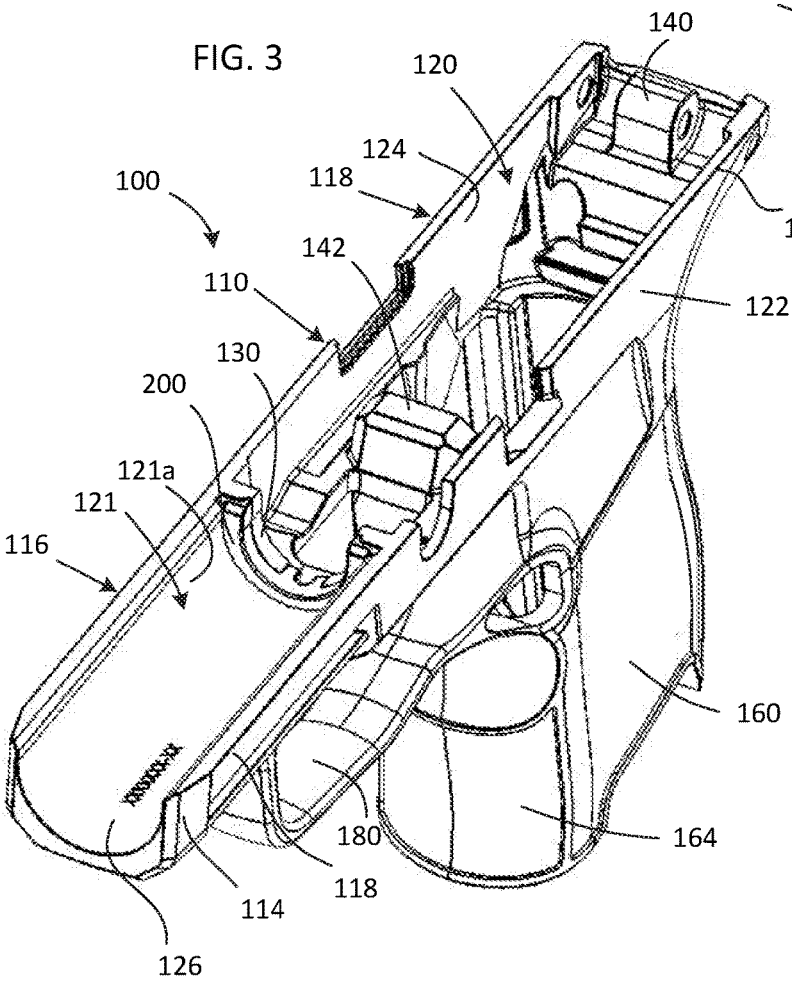
FIG. 3 is a top, front, and left-side perspective view of the grip module of FIG. 1 showing the proximal lug and the distal lug, in accordance with an embodiment of the present disclosure.

Referring now to FIGS. 1-3, a handgun grip module 100 is illustrated in accordance with an embodiment of the present disclosure. FIG. 1 illustrates a left-side, front, and top perspective view; FIG. 2 illustrates a top, rear, and left-side perspective view; and FIG. 3 illustrates a top, front, and left-side perspective view. Grip module 100 includes a body 110 extending longitudinally from a proximal end 112 to a distal end 114. A median plane 102 extends through grip module 100 and bisects grip module 100 into substantially symmetrical left and right portions.

Body 110 includes a proximal body portion 116 and a distal body portion 118 with first sidewall 132 and second sidewall 134 spaced apart and opposing each other from opposite sides of median plane 102. Proximal body portion 116 defines an upwardly open frame box 120 configured to receive a frame 300 as discussed below. A body bottom portion 136 extends between and connects first body sidewall 132 and second body sidewall 134 along distal body portion 118 to define a three-sided recoil spring channel 121 with an open top. Distal body portion 116 includes a recoil spring channel 121 configured to receive a recoil spring 206, recoil guide rod 208, and a slide spring guide 210 on slide assembly 350. Recoil spring channel 121 can define a variety of cross-sectional shapes along inside surface 110*a*, including rectangle, a rectangle with rounded corners, a U shape, a semicircle, an ellipse, or other suitable shape.

A recoil block 130 extends laterally (e.g., in the Y-axis direction) between first body sidewall 122 (e.g., left sidewall) and a second body sidewall 124 (e.g., right sidewall) of body 110. Recoil block 130 has a proximal block face 132 and a distal block face 134 and generally separates frame box 120 from recoil spring channel 121. In some embodiments, recoil block 130 generally has a U-shape consistent with and extending along an inside surface 121*a* of recoil spring channel 121. In some embodiments, recoil block 130 defines an open region or recess configured to receive a recoil spring guide and recoil spring therethrough as the handgun's slide 352 moves proximally and distally along frame 300 due to cycling the action. A reinforcing bracket 200 is disposed in grip module 100 against distal face 134 of recoil block 126. Reinforcing bracket 200 is discussed in more detail below.

A handgrip portion 160 extends transversely down from proximal body portion 116. For example, handgrip portion 160 extends down and rearward from proximal body portion 116 at an angle from about 105° to 115° or other suitable angle. Handgrip portion 160 has a backstrap or proximal grip portion 162 and a front strap or distal grip portion 164. Handgrip portion 160 defines a magazine well 166 extending therethrough. When a magazine 400 loaded with ammunition is installed in magazine well 166 (shown in FIGS. 13-14), the ammunition cartridges feed from magazine 400 to the chamber of the handgun.

Figure 13:
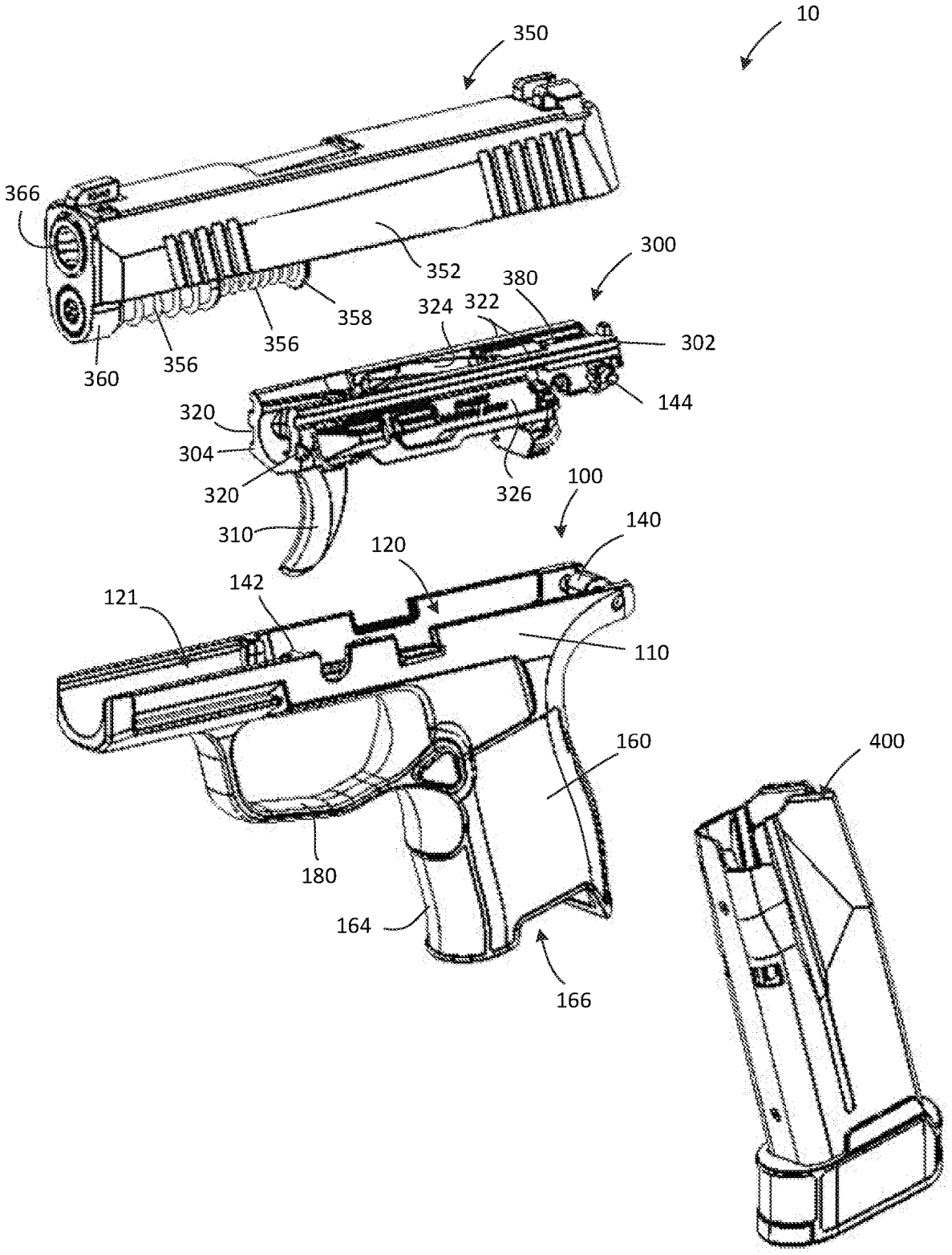
FIG. 13 illustrates an exploded top, front, and left-side perspective view of components of a handgun, in accordance with an embodiment of the present disclosure.
Figure 14:
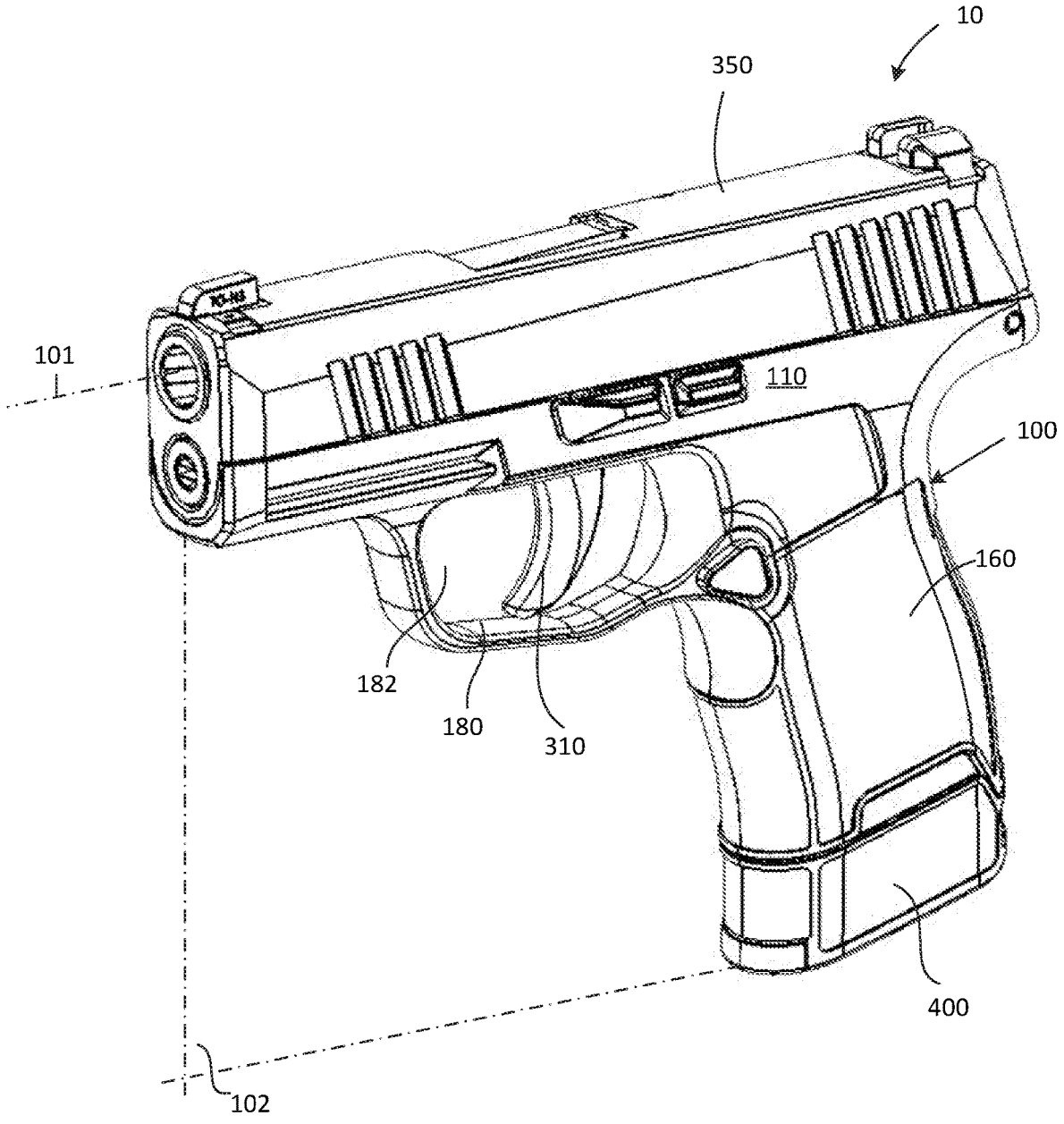
FIG. 14 illustrates a top, front, and left-side perspective view of a handgun in assembled form and including the components of FIG. 13, in accordance with an embodiment of the present disclosure.

In some embodiments, handgun grip module 110 includes a trigger guard 180 extending between handgrip portion 160 and body 110 to enclose an open trigger space 182 sized and configured to receive the trigger finger of a user to manipulate the trigger 310 (shown in FIGS. 13-14). In some embodiments, trigger guard 180 is a separate component from grip module 100 that can be secured to the grip module using, for example, fasteners or a snap fit. In other embodiments, trigger guard 180 is monolithic with grip module 100.

Figure 4:
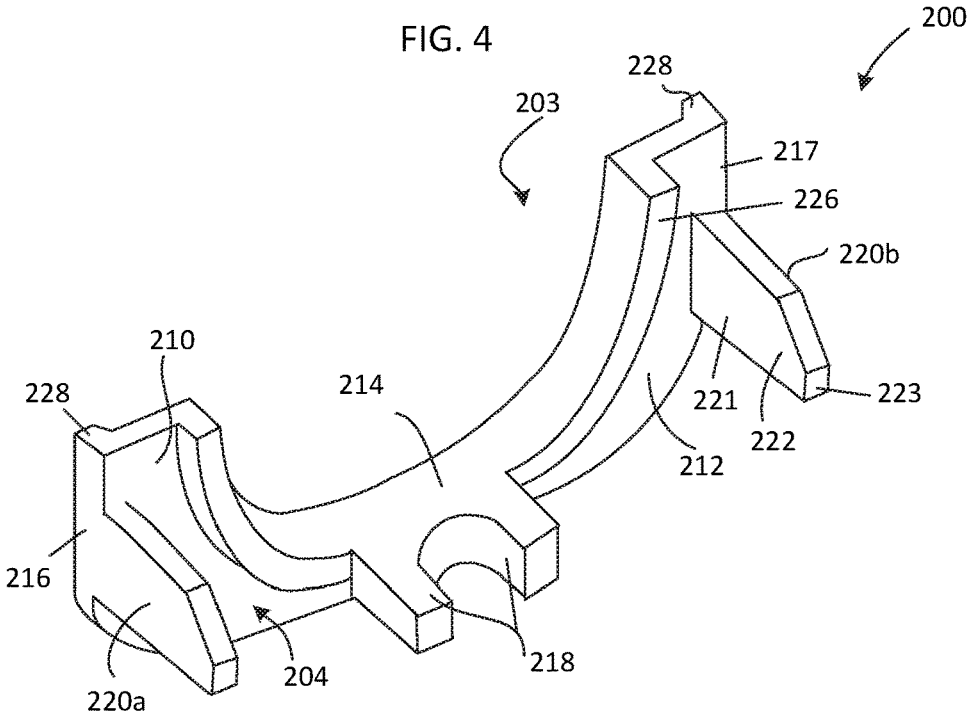
FIG. 4 is a top, rear, and left-side perspective view of a reinforcing bracket, in accordance with an embodiment of the present disclosure.
Figure 5:
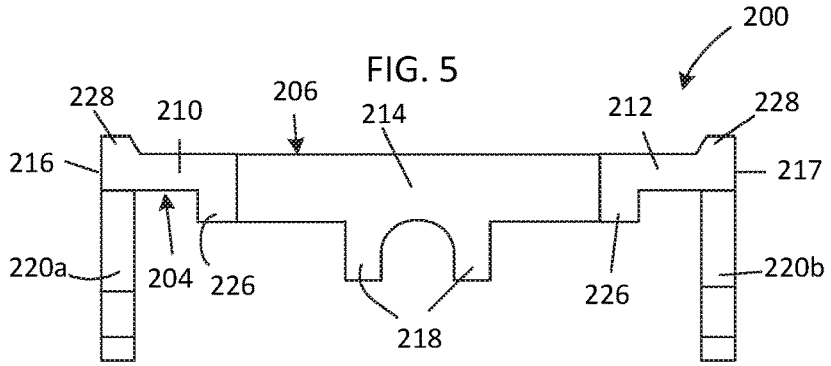
FIG. 5 is a top plan view of the reinforcing bracket of FIG. 4.
Figure 6:
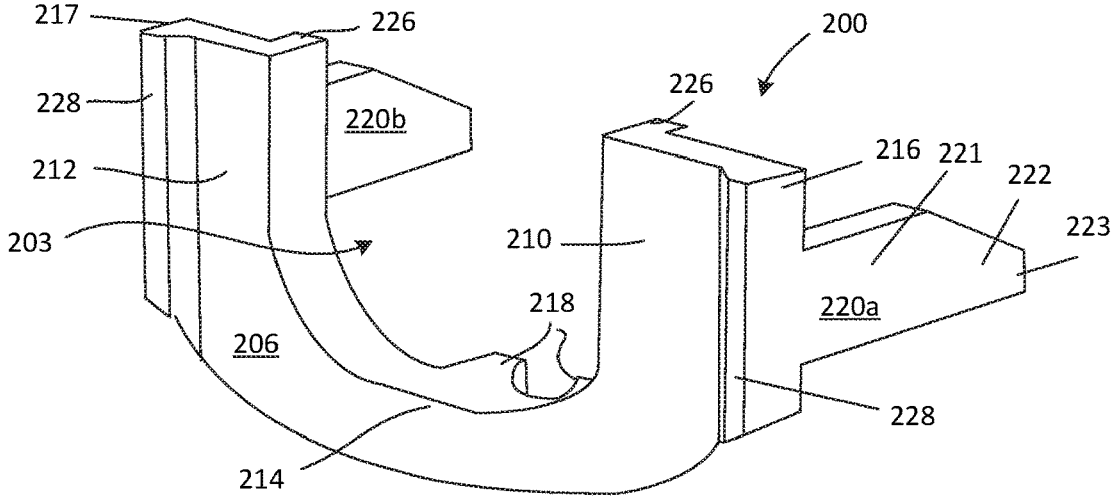
FIG. 6 is a top, front, and left-side perspective view of a reinforcing bracket showing the U-shape and generally planar distal face, in accordance with an embodiment of the present disclosure.

Referring now to FIGS. 4-6, reinforcing bracket 200 is shown in accordance with an embodiment of the present disclosure. FIG. 4 illustrates a rear, top and left-side perspective view; FIG. 5 illustrates a top plan view; and FIG. 6 illustrates a top, front, and left-side perspective view. In some embodiments, reinforcing bracket 200 has a bracket body 202 with a shape corresponding to distal body portion 118 of grip module 100. In some embodiments, reinforcing bracket 200 generally has a U-shape or the like defining a central open region 203. Reinforcing bracket 200 can be configured to mate with and align with recoil block 130 when installed in grip module 100.

In one embodiment, bracket body 202 has a proximal face 204 and a distal face 206. In some embodiments, distal face 206 is substantially planar for contacting recoil spring guide 360 at the end of slide 352 during recoil. In one embodiment, reinforcing bracket 200 defines distal protrusions 228 extending vertically along left and right margins 216, 217, but distal face 206 therebetween is a planar surface positioned to contact recoil guide 360 of slide 352 (shown in FIG. 13) during recoil. In some embodiments, distal protrusions 228 are embedded into first and second sidewalls 122, 124 when reinforcing bracket 200 is installed in grip module 100, where an exposed portion of distal face 206 is planar and generally mimics the shape of distal face 134 of recoil block 130.

In some embodiments, proximal face 204 may define ridges, protrusion or other non-planar features to facilitate molding into the polymer material of grip module 100, such as by injection molding or overmolding. In some embodiments, reinforcing bracket 200 defines recesses and protrusions on proximal face 204 that are configured to engage the polymer material during molding. For example, reinforcing bracket 200 has a left portion 210 and a right portion 212 each extending up from a bracket base portion 214 in a U-shape. Reinforcing bracket 200 can include one or more catch or protrusion 220 that extends proximally from proximal face 204. In one embodiment, a first protrusion 220*a* extends proximally from left portion 210 and a second protrusion 220*b* extends proximally from right portion 212. In some embodiments, first protrusion 220*a* is continuous with left margin 216 of left portion 210 and second protrusion 220*b* is continuous with a right margin 217 of right portion 212. Accordingly, left portion 210, right portion 212, and base portion 214 are configured to extend along and in contact with inside surface 110*a* of distal body portion 118 with protrusions 220 extending proximally along and in contact with first and second body sidewalls 122, 124. Protrusions 220 are positioned to engage distal end 304 of frame 300, but can be partially embedded in sidewalls 122, 124 in some embodiments.

In one embodiment, each protrusion 220 has a protrusion body 221 with a generally rectangular cross-sectional shape. Protrusion body 221 is intended to be embedded in recoil block 130. Each protrusion 220 also has a protrusion tip 222 with a shape tapering from protrusion body 221 to a smaller end 223. Protrusion tip 222 can be pointed, blunt, rounded, or have other shapes. In general, each protrusion tip 222 has a shape corresponding to a protrusion recess 320 defined in distal end 304 of frame 300, where protrusion tip 222 is received in protrusion recess 320 when frame 300 is installed in grip module 100.

In some embodiments, metallic bracket 200 has one or more base protrusions 218 extending proximally from base portion 214. For example, base protrusion 218 is configured to extend through recoil block 130 along body bottom 134. In one embodiment, base protrusion 218 has a U-shape extending proximally from base portion 214 and sized to extend through recoil block 130. In some embodiments, proximal face 204 of reinforcing bracket 200 can define a bracket rim 226 that extends proximally from proximal face 204 and aligns with the U-shape (or other shape) of recoil block 130. When configured with protrusions 220, base protrusion(s) 218, and/or bracket rim 226, the non-planar proximal face 204 can be molded into grip module 100 with portions of reinforcing bracket 200 extending into the grip module material. For example, metallic bracket 200 is overmolded into body 110 with catches, base protrusion 218, and rim 226 extending into or through recoil block 130. In some embodiments, recesses defined between bracket rim 226, protrusions 220, and base protrusion 218 are filled with the grip module material during manufacturing, thereby securing metallic bracket 200 in grip module 100 and making it is integral to body 110 and recoil block 130.

In embodiments discussed above, metallic bracket 200 has bracket body 202 generally extending laterally across handgun body 110, protrusions 220 extending generally parallel to bore axis 101 along sidewalls 122, 124, and base protrusion 218 extending generally parallel to bore axis 101 along bottom portion 126 of body 110. Thus, metallic bracket 200 is configured to distribute recoil forces in several directions to grip module 100, frame 300, and other components of handgun 10.

Figure 7:
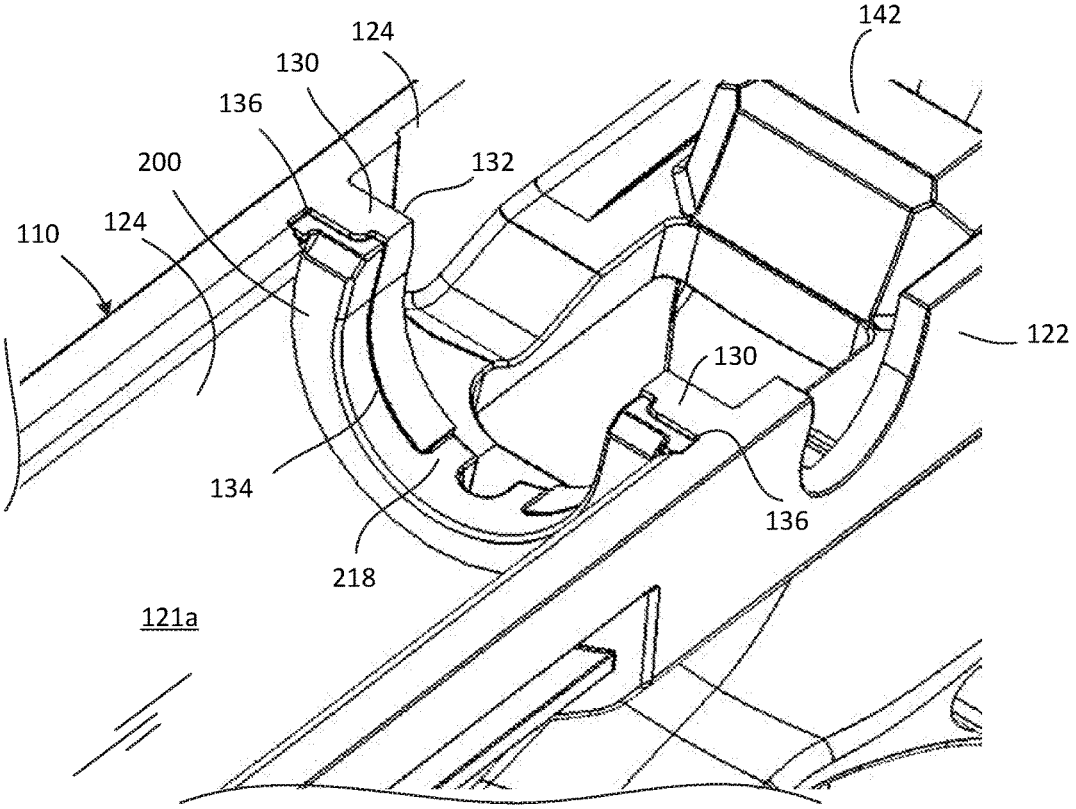
FIG. 7 is a front, top, and left side perspective view showing a close-in look at the recoil block and reinforcing bracket of a handgun grip module, in accordance with an embodiment of the present disclosure.
Figure 8:
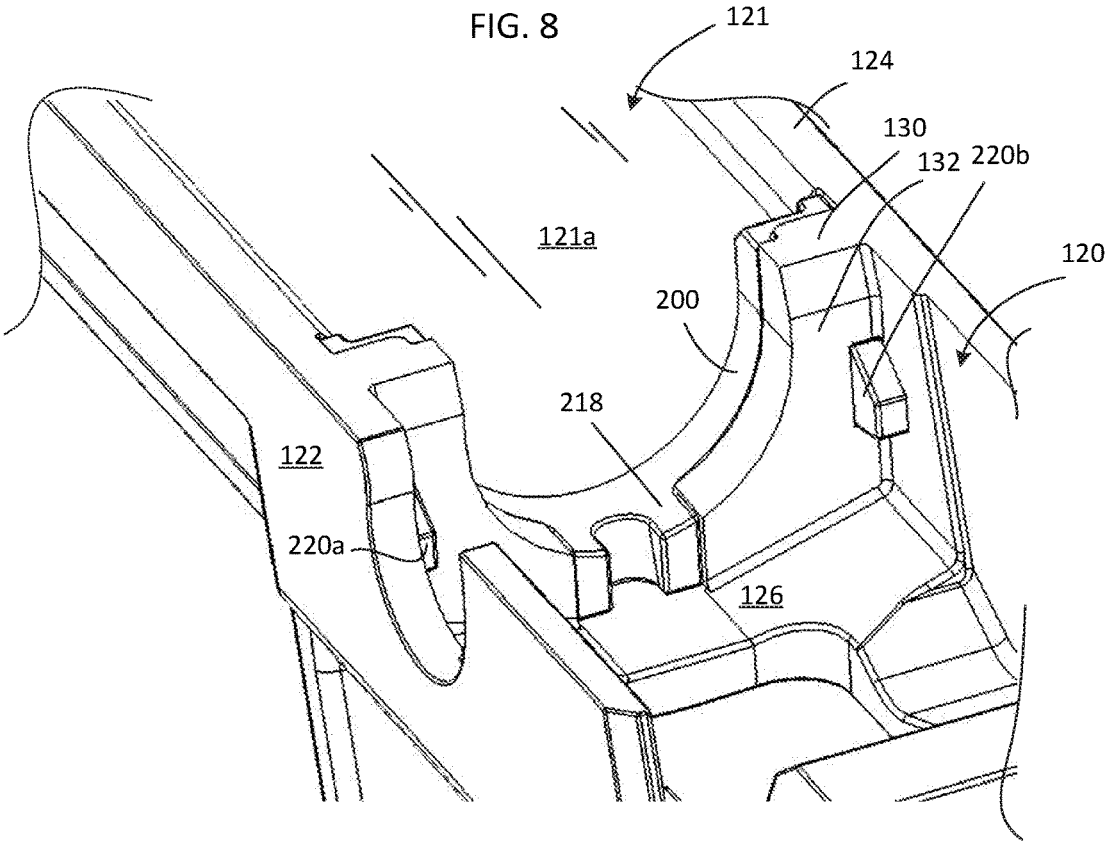
FIG. 8 is a top, rear, and left-side perspective view of the recoil block and reinforcing bracket of FIG. 7, in accordance with an embodiment of the present disclosure.
Figure 9:
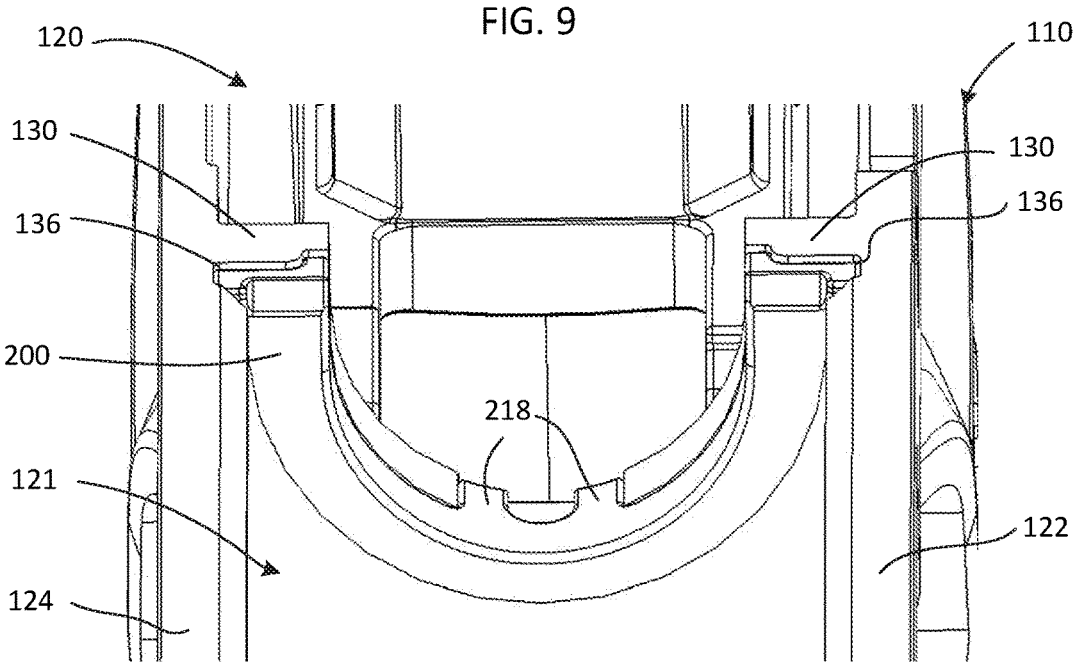
FIG. 9 is a top and front perspective view of the reinforcing bracket disposed against the recoil block, in accordance with an embodiment of the present disclosure.
Figure 10:
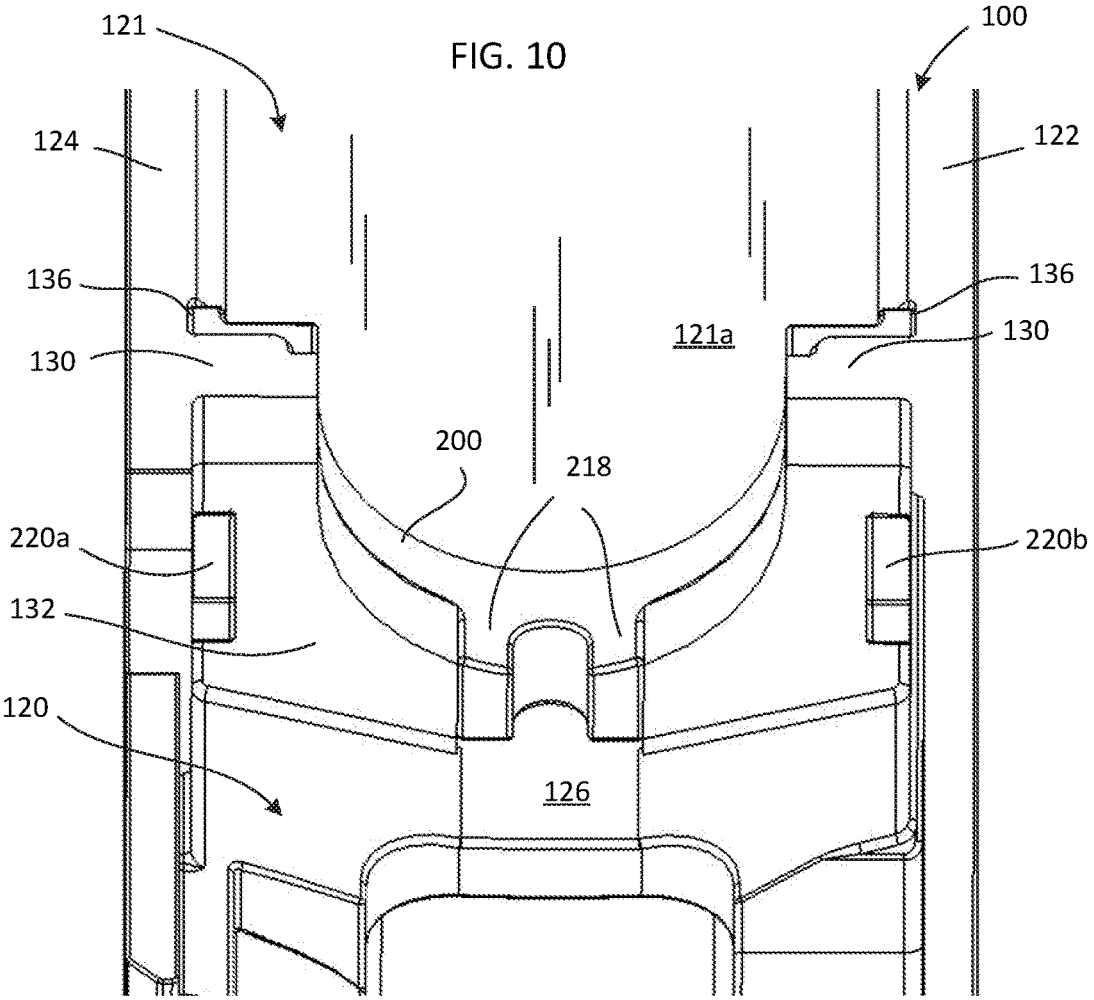
FIG. 10 is a top and rear perspective view of the recoil block and reinforcing bracket of FIG. 9 showing the base protrusion extending through the recoil block along the bottom body portion of the grip module, in accordance with an embodiment of the present disclosure.

Referring now to FIGS. 7-10, a portion of handgun body 110 is shown with metallic bracket 200 disposed against distal face 134 of recoil block 130 in accordance with an embodiment of the present disclosure. FIG. 7 illustrates a top, left-side, and front perspective view; FIG. 8 illustrates a top, rear, and left-side view; FIG. 9 illustrates a top and front perspective view; and FIG. 10 illustrates a top and rear perspective view. In example embodiments, reinforcing bracket 200 is embedded into inside surface 121*a* of recoil spring channel 121 and distal face 134 of recoil block 130. As such, metallic bracket 200 reinforces grip module 100 adjacent recoil block 130 and distributes recoil forces to grip module 100. In some embodiments, metallic bracket 200 is integral with grip module 100 with grip module material overlapping portions of metallic bracket 200. For example, metallic bracket 200 is overmolded into grip module 100.

Metallic bracket 200 is disposed against recoil block 130 extending in a U-shape between first body sidewall 130 and second body sidewall 132. First protrusion 220*a* and second protrusion 220*b* extend through recoil block 130 into frame box 120. A distal grip lug 168 extends up from bottom body portion 126 of frame box 120 and is positioned between trigger opening 184 and magazine well 166. Distal grip lug 168 functions as a stop for the barrel feed ramp (not shown) when the barrel moves proximally after firing. When installed in frame box 120, frame 300 contacts grip module 100 along floor 121, protrusions 220, distal grip lug 168, and proximal grip lug 170. Thus, as the slide 352 moves proximally after firing and hits metallic bracket 200, recoil forces are more evenly transferred into frame 300 and grip module 100. In contrast to other handguns where recoil forces are concentrated at the takedown lever pin, grip module 100 of the present disclosure distributes recoil forces more evenly across a greater area.

In some embodiments, grip module 100 defines a bracket slot 136 in inside surface 121*a* of recoil spring channel 121 adjacent recoil block 130. Bracket slot 136 is sized and shaped to receive metallic bracket 200. For example, bracket slot 136 is shaped during the formation of grip module 100 to receive and mate with metallic bracket along inside surface 121*a* of recoil spring channel 121. Alternately, bracket slot 136 can result from overmolding the polymer material of grip module 100 after placing metallic bracket 200 against recoil block 130 during the manufacturing process. Regardless of the manufacturing method, some embodiments of grip module 100 have metallic bracket 200 partially embedded into the polymer material with metallic bracket 200 abutting recoil block 130. In some embodiments, bracket slot 136 can be configured for removal and replacement of metallic bracket 200. For example, grip module 100, metallic bracket 200, and bracket slot 136 can be shaped individually or together to enable a snap fit of metallic bracket 200 into recoil block 130. In some cases, for example, metallic bracket 200 can slide axially along bottom portion 126 of recoil spring channel 121 for installation into recoil block 130, where protrusions 220 extend through openings or slots defined in recoil block. In other embodiments, protrusions 220 are formed on recoil block 130 and metallic bracket is inserted into bracket slot 136 from the top. Other variations are acceptable.

In some embodiments, base protrusion 218 extends through recoil block 130 along body bottom portion 126. In one embodiment recoil block 130 is discontinuous at base protrusion 218. For example, base protrusion 218 extends completely through recoil block 230 and is positioned to abut a distal end 304 of frame 300. At locations where reinforcing bracket 200 directly contacts frame 300, recoil forces can be transmitted through frame 300 to distal lug 142, proximal lug 140, and other portions of frame in contact with grip module 100. Since frame 300 is typically made of steel or other metal, recoil forces transfer efficiently through the bracket material and dissipate into the grip module material. Metallic bracket 200 can be comprised of a material that exhibits greater stiffness, hardness and/or density compared to the material that comprises the grip module. Metallic bracket 200 can be made of steel, titanium, aluminum, reinforced polymers (e.g., a carbon-fiber composite), or other materials.

Figure 11:
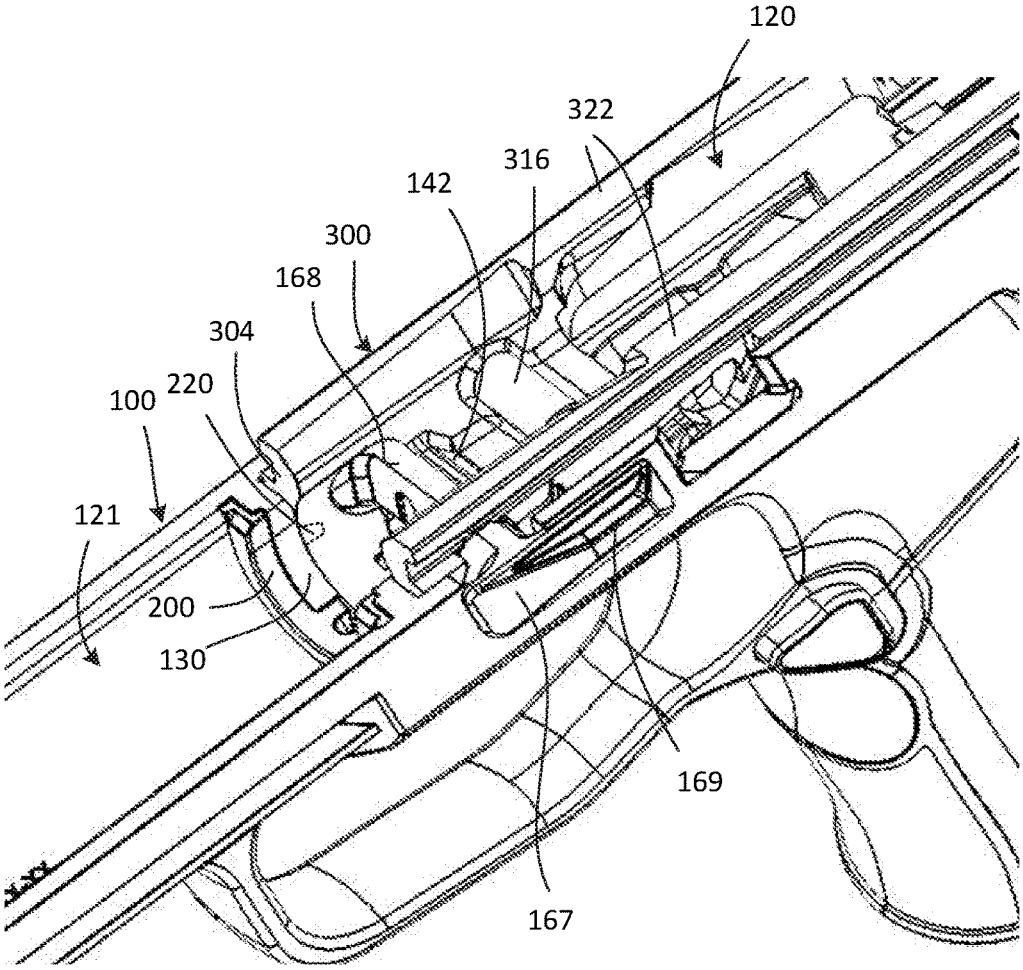
FIG. 11 illustrates top, front, and left-side perspective view of a frame installed in the grip module, in accordance with an embodiment of the present disclosure.
Figure 12:
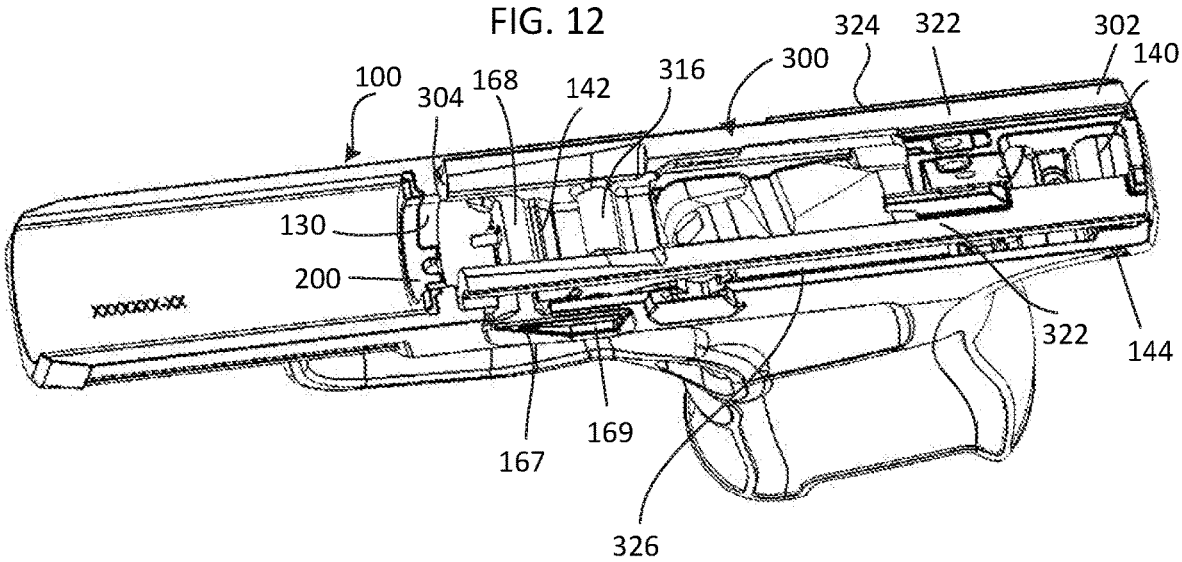
FIG. 12 illustrates a top and left-side perspective view of the frame and grip module of FIG. 11 showing the frame in contact with the recoil block, the distal lug, and the proximal lug, in accordance with an embodiment of the present disclosure.

Referring now to FIGS. 11-12, top and right-side perspective views illustrate grip module 100 with frame 300 installed in frame box 120. Distal end 304 of frame 300 abuts proximal face 132 of recoil block 103 and is retained by engagement with protrusions 220. Proximal end 302 of frame 300 is seated in proximal end 112 of grip module 100 in contact with proximal lug 140. A grip module pin 144 extends laterally through proximal end 112 of grip module 100 and proximal end 302 of frame 300 to secure frame 300 in grip module 100. Frame 300 is retained in grip module 100 by engaging protrusion(s) 220 at distal end 304 and pin 144 at proximal end 302. A takedown lever 167 has a lever wing 169 adjacent an outside of body portion 110 and a takedown lever shaft 168 extending through frame 300 and at least one of first body sidewall 122 and second body sidewall 124. In addition to functioning to permit slide 352 to be taken on and off of frame 300, takedown lever 167 functions as a pin extending through body portion 110 and frame 300.

In some embodiments, proximal end 302 of frame 300 contacts grip module 100 at proximal lug 140 and distal end 304 of frame 300 contacts grip module 100 at recoil block 130. Additionally, distal lug 142 contacts frame 300 via takedown lever shaft 182. Further, barrel 366 engages frame 300 at a barrel lug 316, which extends laterally through frame 300 between first frame sidewall 324 and second frame sidewall 326. Recoil forces are distributed to grip module 100 via the plurality of direct or indirect contact points between frame 300 and grip module 100 that include recoil block 130, reinforcing bracket 200, takedown lever shaft 168, distal lug 142, barrel lug 316, proximal lug 140, slide rails 322, and first and second frame sidewalls 324, 326. Accordingly, the material of grip module 100 has reduced localized forces from firing and recoil and therefore can be made with a reduced amount of material necessary to accommodate these forces.

FIG. 13 illustrates an exploded front, top, and left-side perspective view of component groups of a handgun 10, in accordance with an embodiment of the present disclosure. Handgun 10 includes slide assembly 350 with slide 352, slide recoil guide 360, recoil spring(s) 358, recoil spring rod 358, and barrel 366. Frame 300 includes a fire control group 380 with trigger 310. Takedown lever 167 includes lever wing 169 and takedown lever shaft 168 extending through body 110 and first and second frame sidewalls 324, 326 of frame 300. In some embodiments, takedown lever shaft 168 extends through one or both of first and second sidewall 122, 124 of body portion 110. Distal end 304 of frame 300 defines protrusion recesses 320 corresponding to each protrusion 220 of metallic bracket 200. Grip module 100 defines frame box 120 and recoil channel 121 in addition to components discussed above, where frame 300 can be disposed in frame box 120 and retained by one or more of protrusions 220, takedown lever shaft 168, and frame pin 144. A magazine 400 can be received in magazine well 166 of grip module 100.

The present disclosure also relates to a method of assembling frame 300 into handgun grip module 100. In one embodiment of the method, handgun grip module 100 is provided, such as any of the embodiments discussed above. In one embodiment, grip module 100 comprises a polymer material and includes recoil block 130 extending laterally across body 110 of grip module 100. For example, the recoil block 130 separates frame box 120 from recoil spring box 121. In some embodiments, recoil bock 130 includes metallic bracket 200 disposed against distal face 134 of recoil block 130 and can include protrusions 220 extending proximally through recoil block 130 into frame box 120. Distal end portion 304 of frame 300 is placed in grip module 100 in contact with recoil block 130. In embodiments with one or more protrusion 220, distal end portion 304 of frame 300 is positioned to engage protrusion(s) 220. For example, distal end portion 304 of frame 300 is placed into frame box 120 against recoil block 130 while proximal end 302 of frame 300 is elevated above frame box 120. After distal end portion 304 of frame 300 is positioned in frame box 120, such as with protrusions 220 received in protrusion recesses 320, proximal end portion 302 can then be lowered into frame box 120 in contact with proximal lug 140 and/or proximal body portion 116 of grip module 100. A pin 144 can then be installed through proximal body portion 116 of grip module 100 and proximal end portion 302 of frame 300 to secure frame 300 in grip module 100. With frame 300 positioned in frame box 120, takedown lever 167 can be installed by extending takedown lever shaft 168 into first or second sidewall 122, 124 and through frame 300. In some embodiments, takedown lever shaft 168 extends through both first and second sidewall 122, 124 of body portion 110 when installed. In the assembled form of one embodiment, frame 300 is retained in grip module 100 by engagement with protrusions 220, takedown lever shaft 168, and pin 144. After fixing frame 300 in grip module 100, slide assembly 350 can be installed on frame 300. Numerous variations on the method will be apparent in light of the present disclosure.

FIG. 14 illustrates a top, front, and left-side perspective view of handgun 10 in assembled form and including the component groups shown in FIG. 13. Median plane 102 and bore axis 101 are used as reference points in discussing metallic bracket 200 and other features of the present disclosure. Metallic bracket 200 and other components of handgun 10 may be constructed from any suitable material(s), as will be apparent in light of this disclosure. For example, some embodiments of metallic bracket 200 are constructed from steel, aluminum, titanium, reinforced polymers composites, or other materials. More generally, components of the present disclosure can be constructed from any suitable material, including, for example, materials and finishes compliant with United States Defense Standard MIL-W-13855D (Weapons: Small Arms and Aircraft Armament Subsystems, General Specification For).

In addition to being useful to engage frame 300, metallic bracket 200 structurally reinforces grip module 100. In some embodiments, metallic bracket 20 is molded into grip module 100 with portions extending along sidewalls 122, 124 and bottom portion 126 of body portion 110. Advantageously, metallic bracket 200 provides an improved distribution of recoil forces to grip module 100, including transmitting the recoil forces of slide 352 impacting metallic bracket 130 directly to frame 300, which contacts grip module 100 in various locations. Accordingly, recoil forces transmitted from slide 352 to frame 300, forces transmitted from barrel 366 to frame 300, and forces from firing that are transmitted to frame 300 by other components can be distributed to grip module 100 in a more even, distributed manner. The result is that handgun 10 can utilize polymeric grip module 100 while retaining a compact design without excessive bulk.

Further Example Embodiments

Example 1 is handgun grip module comprising a body portion comprising a polymer material, the body portion extending longitudinally with a first body sidewall, a second body sidewall spaced from the first body sidewall, and a bottom body portion extending between and connecting the first body sidewall and the second body sidewall, the body portion having a distal body portion defining a recoil spring channel and a proximal body portion defining a frame box; a handgrip portion extending transversely from the body portion and having a distal grip portion and a proximal grip portion, the handgrip portion defining a magazine well extending therethrough to the frame box; a recoil block comprising the polymer material is positioned in the body portion between the recoil spring channel and the frame box, the recoil block extending laterally between the first body sidewall and the second body sidewall and defining a U-shape with a distal face and a proximal face; and a metallic bracket disposed against the distal face of the recoil block.

Example 2 includes the subject matter of Example 1, wherein the metallic bracket has a shape corresponding to and aligned with the U-shape of the distal face of the recoil block.

Example 3 includes the subject matter of any of Examples 1 or 2, wherein the metallic bracket has a U-shape with a left portion, a right portion spaced from the left portion, and a base portion extending between and connecting the left portion and the right portion.

Example 4 includes the subject matter of any of Example 1-3 and further comprises at least one protrusion that extends proximally from the metallic bracket, through the recoil block, and into the frame box.

Example 5 includes the subject matter of Example 4, wherein the at least one protrusion includes a left protrusion extending from the left portion along the first body sidewall, and a right protrusion extending from the right portion along the second body sidewall.

Example 6 includes the subject matter of any of Examples 3-5, wherein the base portion includes a base protrusion extending proximally into the recoil block.

Example 7 includes the subject matter of Example 4, wherein an inside surface of the body portion defines a recess configured to receive an outside edge of the metallic bracket.

Example 8 includes the subject matter of any of Examples 1-7, wherein the metallic bracket is partially embedded into the polymer material of the body portion.

Example 9 includes the subject matter of any of Examples 1-8, wherein the metallic bracket is molded into the body portion.

Example 10 includes the subject matter of Example 9, wherein the metallic bracket is overmolded into the body portion.

Example 11 includes the subject matter of any of Examples 1-10 and further comprises a proximal lug in the proximal end portion of the frame box, the proximal lug defining a lateral through opening; and a distal lug in the frame box, the distal lug positioned between the magazine well and the recoil block.

Example 12 includes the subject matter of any of Examples 1-11 and further comprises a frame disposed in the frame box, the frame having a distal frame end portion in contact with the recoil block.

Example 13 includes the subject matter of any of Examples 4-11 and further comprises a frame disposed in the frame box, the frame having a distal frame end portion in contact with the recoil block, wherein the at least one protrusion engages a corresponding recess defined in the distal frame end portion.

Example 14 includes the subject matter of any of Examples 12 or 13, wherein the frame comprises a frame chassis including the distal frame end portion and a proximal frame end portion, the frame chassis having a first frame sidewall extending along the first body sidewall and a second frame sidewall extending along the second body sidewall; and a takedown lever with a lever shaft and lever wing connected transversely to an end of the lever shaft, the lever wing adjacent an outside of the body portion and the takedown lever shaft extending laterally through the frame chassis and through at least one of the first body sidewall and the second body sidewall.

Example 15 includes the subject matter of Example 14, wherein the takedown lever shaft contacts the distal lug and the proximal frame end portion contacts the proximal lug.

Example 16 includes the subject matter of Example 15, wherein the proximal lug extends between and connects the first frame sidewall and the second frame sidewall of the proximal frame end portion.

Example 17 includes the subject matter of any of Examples 14-16 and further comprises a pin extending through the proximal frame end portion and the proximal lug.

Example 18 includes the subject matter of any of Examples 14-17 and further comprises a slide rail extending longitudinally along an upper portion of each of the first frame sidewall and the second frame sidewall; and a fire control assembly attached the frame.

Example 19 includes the subject matter of any of Examples 13-18, wherein a distal frame end portion contacts the recoil block.

Example 20 includes the subject matter of any of Examples 12-19, wherein the proximal end portion of the frame chassis contacts the proximal lug. For example, the proximal lug is received between the first frame sidewall and the second frame sidewall. In some embodiments, the grip module further comprises a removable pin extending through the proximal frame end portion and the proximal end of the grip module, thereby retaining the frame in the frame box.

Example 21 is a semiautomatic handgun utilizing a blowback, locked breech, or hesitation lock operation and including the subject matter of any of Examples 1-20.

Example 22 includes the subject matter of Example 21, wherein the handgun is a striker-fired handgun with a polymer grip module and a frame disposed removably in the grip module.

Example 23 includes the subject matter of any of Examples 21 or 22, wherein the handgun has a double action/single action operation, a single-action-only operation, or a double-action-only operation.

Example 24 includes the subject matter of any of Examples 21-23, wherein the handgun is chambered for ammunition selected from 0.22 LR, 0.380 Auto, 9 mm Luger, 10 mm, 0.40 S&W, 0.357 SIG, or 0.45 AUTO.

Example 25 is a method of assembling a handgun, the method comprising providing a handgun grip module comprising a body portion with opposed spaced-apart sidewalls extending longitudinally, the body portion defining an upwardly open channel with a frame box portion and a spring recoil box portion, a grip portion extending transversely from the body portion, and a recoil block positioned between the frame box and the spring recoil box, the recoil block extending between and connecting the opposed spaced-apart sidewalls; providing a frame with a frame chassis extending longitudinally between a distal frame end portion and a proximal frame end portion; installing the distal frame end portion into the frame box with the distal frame end abutting the recoil block; rotating the proximal frame end portion down into the frame box; and installing a pin through the proximal body portion of the grip module and proximal frame end portion.

Example 26 includes the subject matter of Example 25, wherein the recoil block includes a metallic bracket disposed against a distal face of the recoil block and has at least one protrusion extending from the metallic bracket through the recoil block and into the frame box.

Example 27 includes the subject matter of Example 26, wherein installing the distal frame end portion into the frame box includes engaging the least one protrusion extending proximally from the recoil block into a corresponding recess defined in the distal frame end portion.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A handgun grip module comprising:

a body portion comprising a polymer material, the body portion extending longitudinally with a first body sidewall, a second body sidewall spaced from the first body sidewall, and a bottom body portion extending between and connecting the first body sidewall and the second body sidewall, the body portion having a distal body portion defining a recoil spring channel and a proximal body portion defining a frame box;

a recoil block comprising the polymer material, the recoil block in the distal body portion between the recoil spring channel and the frame box, the recoil block extending laterally between the first body sidewall and the second body sidewall and defining a U-shape with a distal face and a proximal face;

a metallic bracket disposed against the distal face of the recoil block, the metallic bracket having at least one-protrusion extending proximally through the polymer material of the recoil block and into the frame box; and a handgrip portion extending transversely from the body portion and defining a magazine well extending therethrough to the frame box.

2. The handgun grip module of claim 1, wherein the metallic bracket has a shape corresponding to and aligned with the U-shape of the distal face of the recoil block.

3. The handgun grip module of claim 1, wherein the metallic bracket has a U-shape with a left portion, a right portion spaced from the left portion, and a base portion extending between and connecting the left portion and the right portion.

4. The handgun grip module of claim 3, wherein the at least one protrusion includes:

a left protrusion extending from the left portion along the first body sidewall; and a right protrusion extending from the right portion along the second body sidewall;

wherein an end of the left protrusion and an end of the right protrusion extend proximally from the proximal face of the recoil block.

5. The handgun grip module of claim 3, wherein the base portion of the metallic bracket includes a base protrusion extending proximally into the recoil block.

6. The handgun grip module of claim 1, wherein an inside surface of the body portion defines a recess configured to receive an outside edge of the metallic bracket.

7. The handgun grip module of claim 1, wherein the metallic bracket is partially embedded into the polymer material of the body portion.

8. The handgun grip module of claim 1 further comprising:

a proximal lug in the proximal end portion of the frame box, the proximal lug defining a lateral through-opening; and a distal lug in the frame box, the distal lug positioned between the magazine well and the recoil block.

9. The handgun grip module of claim 1 further comprising:

a frame disposed in the frame box, the frame having a distal frame end portion in contact with the recoil block, the distal frame end portion defining a recess receiving the at least one protrusion.

10. The handgun grip module of claim 3, further comprising a frame disposed in the frame box, the frame having a distal frame end portion with a distal face in contact with the recoil block, the distal frame end portion defining a recess receiving the at least one protrusion.

11. The handgun grip module of claim 10, wherein the frame comprises:

a frame chassis including the distal frame end portion and a proximal frame end portion, the frame chassis having a first frame sidewall extending along the first body sidewall and a second frame sidewall extending along the second body sidewall; and a takedown lever with a lever shaft and a lever wing connected transversely to an end of the lever shaft, the lever wing adjacent an outside of the body portion and the takedown lever shaft extending laterally through the frame chassis and through at least one of the first body sidewall and the second body sidewall.

12. The handgun grip module of claim 11, wherein the takedown lever shaft contacts the distal lug and the proximal frame end portion contacts the proximal lug.

13. The handgun grip module of claim 12, wherein the proximal lug extends between and connects the first frame sidewall and the second frame sidewall of the proximal frame end portion.

14. The handgun grip module of claim 13 further comprising a pin extending through the proximal frame end portion and the proximal lug.

15. The handgun grip module of claim 11 further comprising:

a slide rail extending longitudinally along an upper portion of each of the first frame sidewall and the second frame sidewall; and a fire control assembly attached to the frame.

16. The handgun grip module of claim 1, wherein the metallic bracket is made of steel, aluminum, or titanium.

17. A method of assembling a handgun, the method comprising:

providing a handgun grip module comprising a body portion with opposed spaced-apart sidewalls extending longitudinally, the body portion defining an upwardly open channel with a frame box portion and a spring recoil box portion, a handgrip portion extending transversely down from the body portion, a recoil block positioned between the frame box and the spring recoil box, the recoil block extending between and connecting the opposed spaced-apart sidewalls; and a metallic bracket disposed against the distal face of the recoil block, the metallic bracket having at least one protrusion extending proximally through material of the recoil block and into the frame box;

providing a frame with a frame chassis extending longitudinally between a distal frame end portion and a proximal frame end portion, the distal frame end portion defining a recess for the at least one protrusion extending proximally through the recoil block;

installing the distal frame end portion into the frame box with the distal frame end portion abutting the recoil block and the at least one protrusion received in the recess in the distal frame end portion;

rotating the proximal frame end portion down into the frame box; and installing a pin through the proximal body portion of the grip module and through the proximal frame end portion.

* * * * *